US009953788B2

(12) United States Patent
Roehrig et al.

(10) Patent No.: US 9,953,788 B2
(45) Date of Patent: Apr. 24, 2018

(54) ELECTRIC CIRCUIT BREAKER

(71) Applicant: Siemens Aktiengesellschaft, Munich (DE)

(72) Inventors: Fabian Roehrig, Berlin (DE); Ralf Studt, Berlin (DE)

(73) Assignee: SIEMENS AKTIENGSELLSCHAFT, Munich (DE)

( * ) Notice: Subject to any disclaimer, the term of this patent is extended or adjusted under 35 U.S.C. 154(b) by 4 days.

(21) Appl. No.: 15/101,010

(22) PCT Filed: Dec. 2, 2014

(86) PCT No.: PCT/EP2014/076199

§ 371 (c)(1),
(2) Date: Jun. 2, 2016

(87) PCT Pub. No.: WO2015/090934

PCT Pub. Date: Jun. 25, 2015

(65) Prior Publication Data

US 2016/0300681 A1 Oct. 13, 2016

(30) Foreign Application Priority Data

Dec. 20, 2013 (DE) ..... 10 2013 227 004

(51) Int. Cl.
*H01H 71/12* (2006.01)
*H01H 3/30* (2006.01)

(52) U.S. Cl.
CPC ..... *H01H 71/12* (2013.01); *H01H 3/3005* (2013.01); *H01H 3/3021* (2013.01); *H01H 3/3031* (2013.01); *H01H 2235/01* (2013.01)

(58) Field of Classification Search
CPC ..... Y10T 74/19874; Y10T 74/19642; Y10T 74/19647; H01H 3/3021;
(Continued)

(56) References Cited

U.S. PATENT DOCUMENTS 3,689,721 A 9/1972 McGuffie
4,491,709 A * 1/1985 Chabot ..... H01H 3/3021 200/288
(Continued)

FOREIGN PATENT DOCUMENTS

CN 86103471 A 12/1986
DE 4416106 A1 10/1995
(Continued)

OTHER PUBLICATIONS

German Office Action dated Oct. 24, 2014.
(Continued)

*Primary Examiner* — Ahmed Saeed
(74) *Attorney, Agent, or Firm* — Harness, Dickey & Pierce, P.L.C.

(57) ABSTRACT

An electric circuit breaker including a spring energy store drive having a spring and a manual winding device for manually tensioning the spring. In accordance with an embodiment, the manual winding device includes a rotatable latching disk, a latching pawl arranged next to the disk, and a manual actuating device connected to the latching pawl. The latching pawl is guidable into a latching toothed portion of the disk. The pawl is also capable of moving, owing to an actuation of the actuating device. As a result, the disk is capable of rotating along a preset desired rotation direction for tensioning the spring. The latching toothed portion is asymmetrical and a force transmission from the pawl onto the disk is possible along the desired rotation direction. The disk slides along the pawl when the disk rotates along the desired rotation direction more quickly than the pawl.

20 Claims, 5 Drawing Sheets

(58) Field of Classification Search
CPC ..... H01H 2003/3063; H01H 2043/107; H01H 3/30; H01H 71/12; H01H 3/2005; H01H 3/3031; H01H 2235/01
USPC ..... 200/335, 400, 501; 74/412 R, 413, 435
See application file for complete search history.

(56) References Cited

U.S. PATENT DOCUMENTS

| | | | |
|---|---|---|---|
| 4,596,310 | A | 6/1986 | Hatakeyama et al. |
| 4,705,144 | A | 11/1987 | Yabe |
| 5,489,755 | A | 2/1996 | Castonguay et al. |
| 5,883,351 | A | 3/1999 | Castonguay et al. |
| 7,902,472 | B2 | 3/2011 | Godesa |

FOREIGN PATENT DOCUMENTS

| | | | |
|---|---|---|---|
| DE | 102006006907 | A1 | 8/2007 |
| EP | 756749 | B1 | 4/1995 |

OTHER PUBLICATIONS

International Search Report and Written Opinion dated Mar. 27, 2015.
Chinese Office Action dated Mar. 30, 2017.
Canadian Office Action dated Apr. 20, 2017.

* cited by examiner

ELECTRIC CIRCUIT BREAKER

PRIORITY STATEMENT

This application is the national phase under 35 U.S.C. § 371 of PCT International Application No. PCT/EP2014/076199 which has an International filing date of Dec. 2, 2014, which designated the United States of America and which claims priority to German patent application number DE 102013227004.6 filed Dec. 20, 2013, the entire contents of which are hereby incorporated herein by reference.

FIELD

An embodiment of invention generally relates to electrical circuit breakers.

BACKGROUND

Circuit breakers are sold by Siemens AG under the product names Siemens 3AH and 3AE circuit breakers. The circuit breakers which are already known have a stored-energy spring drive and a manual winding device with which the stored-energy spring drive can be tensioned. In these circuit breakers which are already known, the manual winding device comprises a handcrank and also a two-stage worm gear mechanism.

SUMMARY

In at least one embodiment, an electrical circuit breaker includes a stored-energy spring drive which can be manually tensioned and which has a particularly simple structural design but nevertheless prevents operators from being put at risk in the event of a malfunction or incorrect operation of the circuit breaker.

According to at least one embodiment of the invention, an electrical circuit breaker is disclosed. Advantageous refinements of the circuit breaker according to the invention are specified in the claims.

According to at least one embodiment of the invention, an electrical circuit breaker is provided where the manual winding device has a rotatable latching disk, a latching pawl which is arranged next to the latching disk, in particular at the end of the latching disk, and a manual operating device, which is connected to the latching pawl, for moving the latching pawl, the latching pawl is guided in a controlled manner or can be guided in a controlled manner into a latching tooth system of the latching disk. By virtue of operation of the operating device, the latching pawl can move. As a result the latching disk can rotate along a prespecified desired rotation direction for tensioning the spring, and the latching tooth system is asymmetrical in such a way that transmission of force from the latching pawl to the latching disk is possible only along the desired rotation direction and the latching disk slides along the latching pawl when the latching disk rotates along the desired rotation direction more quickly than the latching pawl.

BRIEF DESCRIPTION OF THE DRAWINGS

The invention will be explained in greater detail below with reference to example embodiments; in this context, by way of example, FIG. 1 shows an example embodiment of an electrical circuit breaker having a stored-energy spring drive, which has a spring, and a manual winding device for manually tensioning the spring, wherein FIG. 1 shows the state in which the spring is relieved of tension.

For the sake of clarity, the same reference symbols are always used for identical or comparable components in the figures.

DETAILED DESCRIPTION OF THE EXAMPLE EMBODIMENTS

Figure 1:
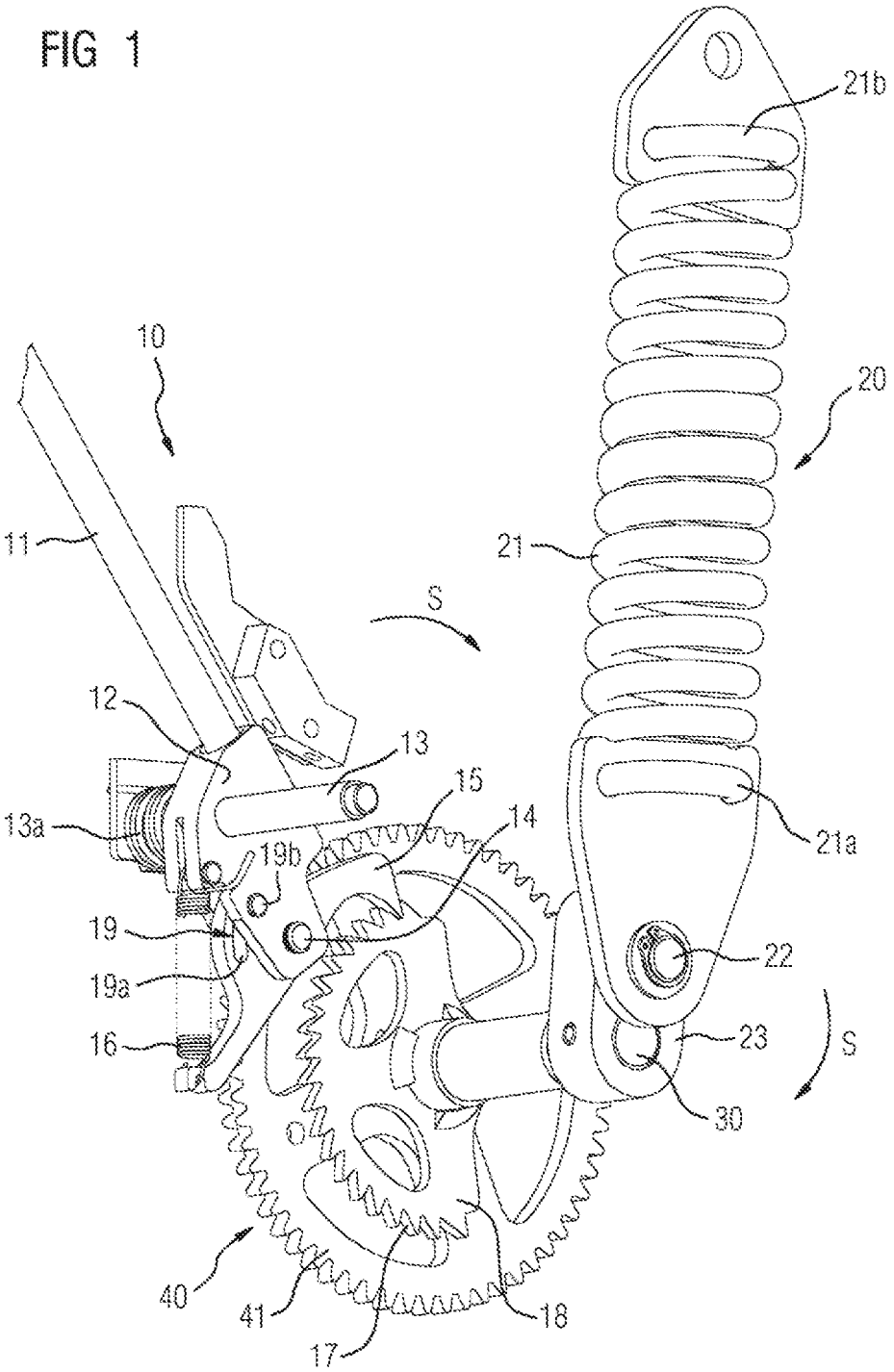

According to at least one embodiment of the invention, an electrical circuit breaker is provided where the manual winding device has a rotatable latching disk, a latching pawl which is arranged next to the latching disk, in particular at the end of the latching disk, and a manual operating device, which is connected to the latching pawl, for moving the latching pawl, the latching pawl is guided in a controlled manner or can be guided in a controlled manner into a latching tooth system of the latching disk. By virtue of operation of the operating device, the latching pawl can move. As a result the latching disk can rotate along a prespecified desired rotation direction for tensioning the spring, and the latching tooth system is asymmetrical in such a way that transmission of force from the latching pawl to the latching disk is possible only along the desired rotation direction and the latching disk slides along the latching pawl when the latching disk rotates along the desired rotation direction more quickly than the latching pawl.

A significant advantage of the circuit breaker according to at least one embodiment of the invention can be seen in that, with this circuit breaker, a reaction on or feedback to the manual winding device and therefore on/to an operator operating the manual winding device is precluded, even if incorrect operation of or a malfunction in the circuit breaker were to occur. On account of the asymmetry of the latching tooth system provided according to at least one embodiment of the invention, it is ensured that the latching disk can ratchet along the latching pawl when the latching disk rotates along the desired rotation direction more quickly than the latching pawl in the event of a malfunction or incorrect operation of the circuit breaker. Therefore, transmission of force from the latching pawl to the latching disk is possible only along the desired rotation direction and also only when the latching pawl moves more quickly than the latching disk in the event of operation by the manual winding device, that is to say when tensioning of the stored-energy spring drive is desired by a user or effected by a user. In the event of a malfunction or incorrect operation of the circuit breaker or in the case of the latching disk—for whatever reason—rotating automatically along the desired rotation direction, there is no transmission of force between the latching pawl and the latching disk, and therefore an operator cannot be put at risk.

It is considered to be particularly advantageous when the latching tooth system of the latching disk is an external tooth system in the form of an arc of a circle. The effect of this design of the latching disk is that the latching disk interacts with the latching pawl only when the spring of the stored-energy spring drive is tensioned by rotation of the latching disk along the desired rotation direction. During the phase in which the spring is relieved of tension, it is possible to ensure—on account of the shape of the external tooth system in the form of an arc of a circle—that the latching disk is mechanically separated from the latching pawl and there is no transmission of force between these two components.

The angle of the arc of a circle preferably has an angle value of between 160° and 200° (inclusive).

In the case of a structurally simple and therefore advantageous design of at least one embodiment of the circuit breaker, it is provided that the latching disk is connected in a rotationally fixed manner to a switching shaft of the circuit breaker, the spring of the stored-energy spring drive forms a switch-on spring, and a first rotation angle range of the switching shaft—in the event of rotation along the desired rotation direction—serves to tension the spring, and a second rotation angle range of the switching shaft—in the event of rotation along the desired rotation direction—serves to relieve the spring of tension and to switch on the circuit breaker.

The external tooth system, which is in the form of an arc of a circle, of the latching disk and the latching pawl are preferably arranged relative to one another in such a way that the latching pawl engages or can engage into the external tooth system, which is in the form of an arc of a circle, when the switching shaft is in the first rotation angle range.

Accordingly, it is considered to be advantageous when the external tooth system, which is in the form of an arc of a circle, of the latching disk and the latching pawl are arranged relative to one another in such a way that the latching pawl disengages from the external tooth system, which is in the form of an arc of a circle, when the switching shaft is in the second rotation angle range.

In respect of the design of the manual winding device, it is considered to be advantageous when the manual winding device has a rocker which can be pivoted about a fixed rocker axis and on which the latching pawl is held such that it can pivot about a pivot axis, wherein the pivot axis lies parallel to the rocker axis and, in the event of the rocker being pivoted about the rocker axis, the pivot axis of the latching pawl is likewise rotated about the rocker axis.

The pivot region of the latching pawl is preferably delimited in the direction of the latching disk (or in the direction of the switching shaft) by way of a stop.

In order to ensure a defined position of the latching pawl, it is considered to be advantageous when the manual winding device comprises a positioning spring which generates a spring force on the latching pawl in the direction of the latching disk.

The spring of the stored-energy spring drive can be tensioned in a particularly simple and therefore advantageous manner in the event of rotation of the switching shaft when a spring end of the spring of the stored-energy spring drive is fastened to the switching shaft in an eccentric manner—in relation to the shaft axis—and the rotation axis of the latching disk and the axis of the switching shaft are identical.

The circuit breaker of at least one embodiment preferably has a return movement-limiting mechanism which prevents rotation of the latching disk counter to the desired rotation direction.

The return movement-limiting mechanism preferably comprises a gear wheel which is arranged on the switching shaft of the circuit breaker coaxially to the latching disk in a manner fixed in terms of rotation.

FIG. 1 shows a manual winding device 10 which is suitable for tensioning a stored-energy spring drive 20 of an electrical circuit breaker, not illustrated in any further detail.

The stored-energy spring drive 20 comprises a spring 21, the spring end 21*a* of the spring which is at the bottom in FIG. 1 being fastened to a switching shaft 30 of the circuit breaker in an eccentric manner by way of a fastening bolt 22 and an eccentric element 23. The spring end 21*b* which is at the top in FIG. 1 is mounted in a stationary manner or in a manner fixed to the housing. The spring 21 may be, for example, a switch-on spring, the spring energy of the switch-on spring being used to switch on the circuit breaker.

In order to tension the spring 21 of the stored-energy spring drive 20, the bottom spring end 21*a* is pivoted downward from the position shown in FIG. 1 along a desired rotation direction S by the switching shaft 30 being rotated along the desired rotation direction S.

In order to allow the spring 20 to be manually tensioned or to allow the switching shaft 30 to be manually rotated about the desired rotation direction S, the manual winding device 10 has a manual operating device 11 in the form of a rod. The operating device 11 is fastened to a first rocker end of a rocker 12 which can be pivoted about a rocker axis 13. A pivot axis 14 which holds a latching pawl 15 in a pivotable manner is arranged in the region of a second rocker end of the rocker 12. The latching pawl 15 is pushed onto an external tooth system 17, which is in the form of an arc of a circle, of a latching disk 18 by way of a positioning spring 16. A rotary spring 13*a* serves to rotate the rocker 12 into a prespecified starting position if manual operation is not performed.

The pivot axis 14 preferably lies parallel to the rocker axis 13, so that, in the event of the rocker 12 being pivoted about the rocker axis 13, the pivot axis 14 which holds the latching pawl 15 is likewise rotated about the rocker axis 13.

The external tooth system 17, which is in the form of an arc of a circle, is asymmetrical, so that transmission of force from the latching pawl 15 to the latching disk 18 is possible only along the desired rotation direction S and the latching disk 18 slides along the latching pawl 15 when the latching disk 18 rotates along the desired rotation direction S more quickly than the latching pawl 15. Rotation of the latching disk 18 "more quickly" in this way relative to the latching pawl 15 can occur, for example, when a motor drive, not shown any further in FIG. 1, of the circuit breaker is activated and the spring 21 of the stored-energy spring drive 20 is additionally tensioned by way of the motor drive.

In the example embodiment according to FIG. 1, the angle of the arc of a circle of the external tooth system 17, which is in the form of an arc of a circle, has a value of approximately 180°. An angle of the arc of a circle of this kind ensures that the latching pawl 15 is in engagement with the latching disk 18 only when the spring 21 is intended to be tensioned from the untensioned state, shown in FIG. 1, by rotation of the switching shaft 30 along the desired rotation direction S.

The spring 21 reaches a tensioned state—starting from the illustration according to FIG. 1—by rotation of the switching shaft 30 or by rotation of the latching disk 18 through 180°. If the spring 21 is in its tensioned state, the latching pawl 15 disengages from the external tooth system 17 or from the latching disk 18, so that the manual winding device is automatically separated from the stored-energy spring drive 20.

The manual winding device 10 is operated in the following manner in order to tension the spring 21: the manual operating device 11 is made to perform an oscillating movement by which the rocker 12 is pivoted about the rocker axis 13. Pivoting of the rocker 12 about the rocker axis 13 leads to pivoting of the pivot axis 14 and therefore to a movement of the latching pawl 15 tangentially along the external tooth system 17 of the latching disk 18. During the movement phase, in which the latching pawl 15 is moved along the desired rotation direction S, the latching pawl 15 will engage into the external tooth system 17 so as to transmit force and the latching disk 18 will rotate along the desired rotation direction S, as a result of which the switching shaft 30 is also rotated about the desired rotation direction S and the spring 21 is tensioned.

There is no transmission of force between the latching pawl 15 and the external tooth system 17 or the latching disk 18 in the event of the backward movement of the latching pawl 15 on account of the asymmetry of the teeth of the external tooth system 17, so that the latching pawl 15 will ratchet along the external tooth system 17, without the latching disk 18 rotating backward in the process.

In order to reliably avoid backward rotation of the latching disk 18 counter to the desired rotation direction S, the circuit breaker according to FIG. 1 is equipped with a return movement-limiting mechanism 40 which comprises a gear wheel 41. The gear wheel 41 is connected to a pawl mechanism, not illustrated any further, which allows rotation of the gear wheel 41 and therefore the rotation of the switching shaft 30 only in the desired rotation direction S, and otherwise prevents the rotation.

Figure 2:
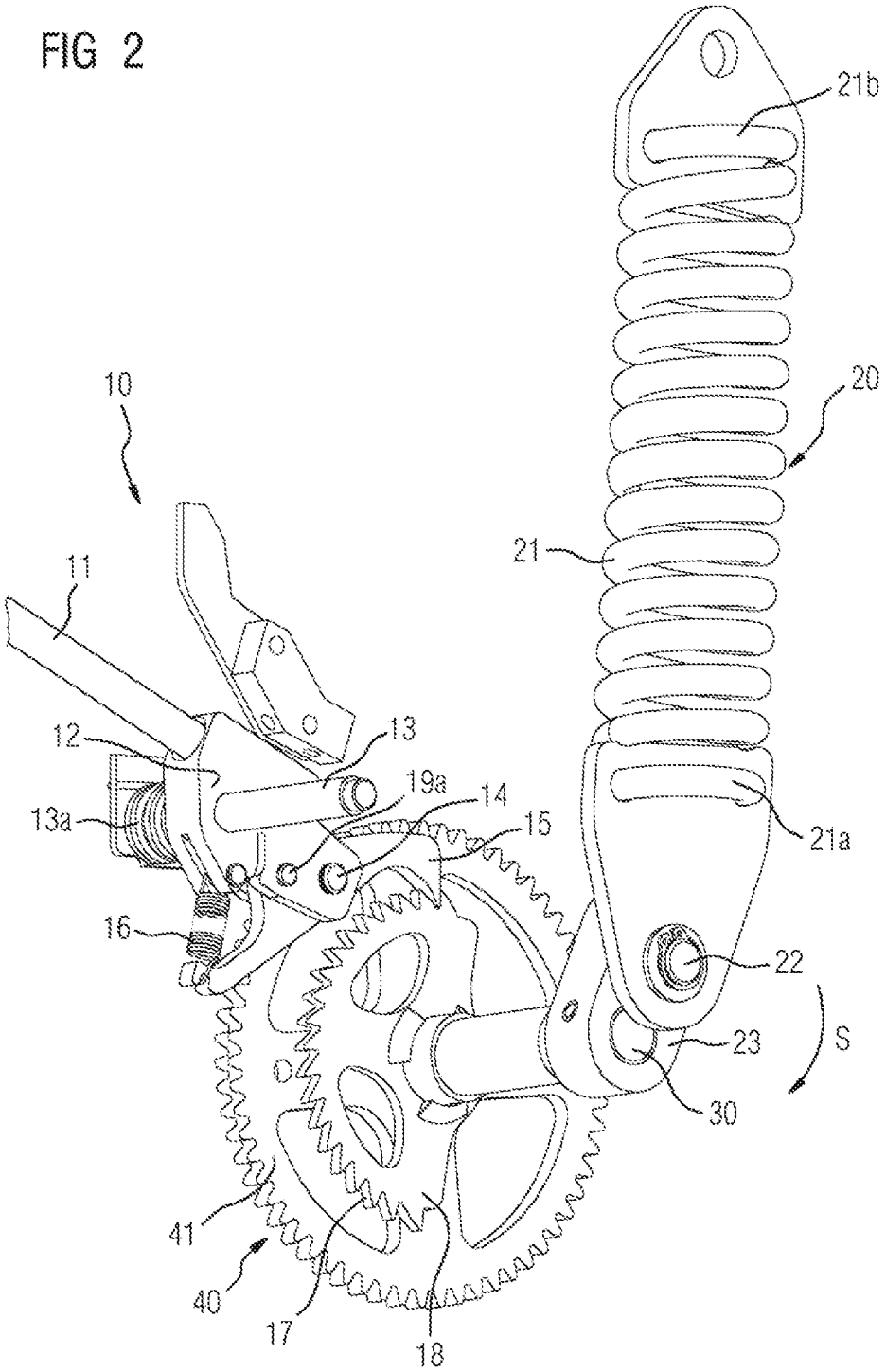
FIGS. 2-3 show the tensioning of the spring according to FIG. 1 on the basis of different spring tension states.

FIG. 2 shows the rotation of the latching disk 18 along the desired rotation direction S as soon as the manual operating device 11 is operated and, together with this, the latching pawl 15 is pushed forward by virtue of the rocker 12 pivoting. It can be seen that, by virtue of the switching shaft 30 rotating, the spring end 21*a* has already been moved slightly downward owing to the eccentric fastening to the switching shaft 30.

Figure 3:
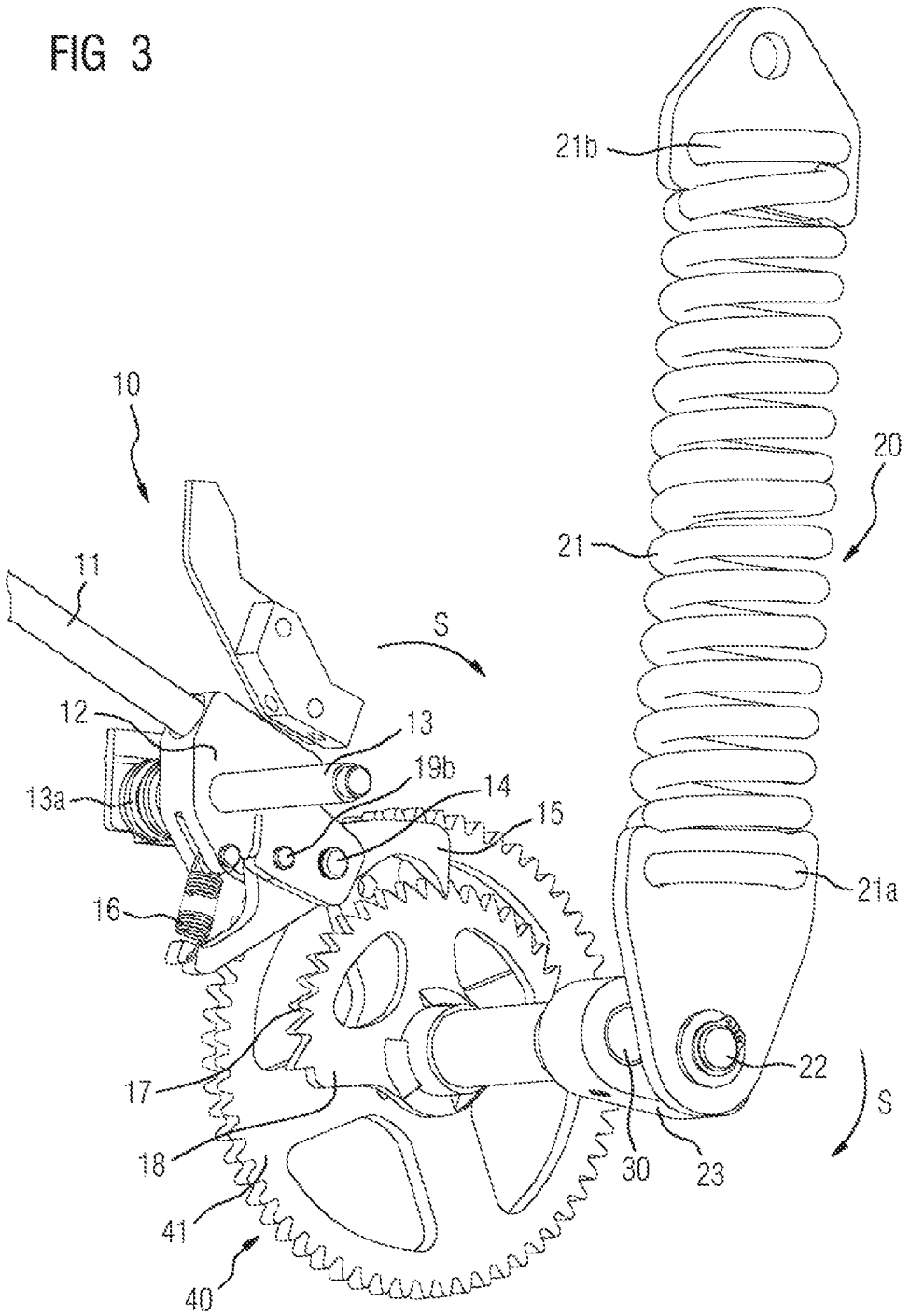

FIG. 3 shows a further state of the stored-energy spring drive 20 during the tensioning process in greater detail. It can be seen that the latching pawl 15 engages into a central region of the external tooth system 17 of the latching disk 18 and the spring 21 of the spring energy store 20 is therefore already partially tensioned approximately by half.

Figure 4:
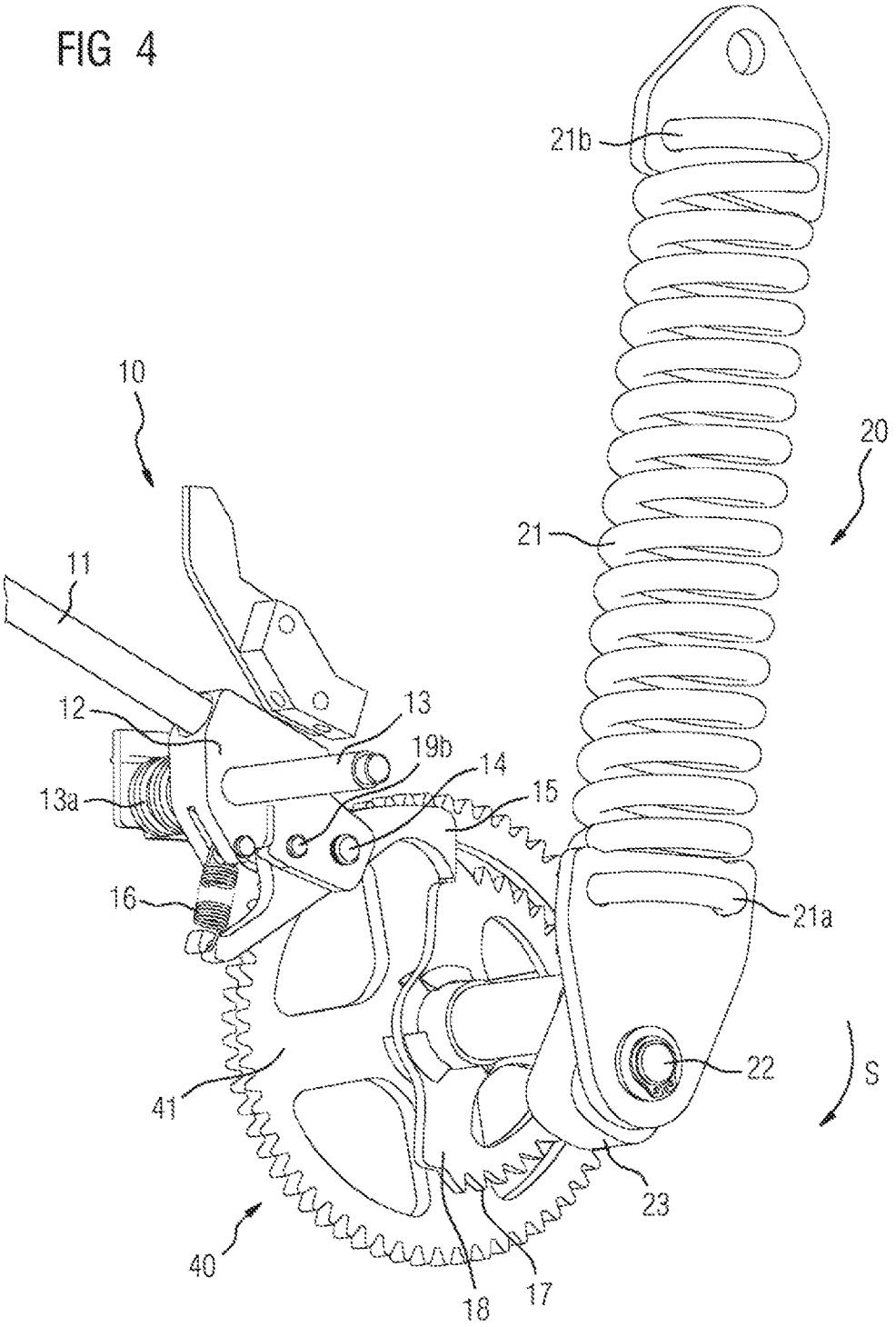
FIG. 4 shows the tensioned state of the spring according to FIG. 1.

FIG. 4 shows the spring 21 and, respectively, the stored-energy spring drive 20 in the fully tensioned state. It can be seen that the latching mechanism 15 has reached the last tooth of the external tooth system 17, which is in the form of an arc of a circle, of the latching disk 18 and a further oscillating movement of the manual operating device 11 cannot cause further tensioning of the spring 21 or further rotation of the switching shaft 30 along the desired rotation direction S.

Therefore, in summary, FIGS. 1 to 4 show that a first rotation angle range of the switching shaft 30—in the event of rotation along the desired rotation direction S—serves to tension the spring 21 and a second rotation angle range of the switching shaft 30 serves to relieve the spring of tension and to switch on the circuit breaker. In the example embodiment according to FIGS. 1 to 4, the first rotation angle range is defined by the top position of the spring end 21*a* of the spring 21 according to FIG. 1 and the bottom position of the spring end 21*a* of the spring 21 according to FIG. 4.

The external tooth system 17 of the latching disk 18 is in the first rotation angle range of the switching shaft 30, as a result of which, in the first rotation angle range of the switching shaft 30, the spring 21 can be tensioned via the operating device 11. The second rotation angle range of the switching shaft 30 lies between the state according to FIG. 4 and the state according to FIG. 1 when the switching shaft 30 is rotated further along the desired rotation direction S. There is no external tooth system on the latching disk 18 in the second rotation angle range of the switching shaft 30, so that the latching pawl 15 cannot engage into the latching disk 18 in the second rotation angle range of the switching shaft 30.

In order to prevent the latching pawl 15 from being able to pivot too far in the direction of the switching shaft 30 in the second rotation angle range of the switching shaft 30, the manual winding device 10 is preferably equipped with a stop 19 which limits the ability of the latching pawl 15 to pivot about the pivot axis 14. The stop 19 can be formed, for example, by an elongate hole 19*a* and a bolt 19*b* (cf. FIG. 1).

Figure 5:
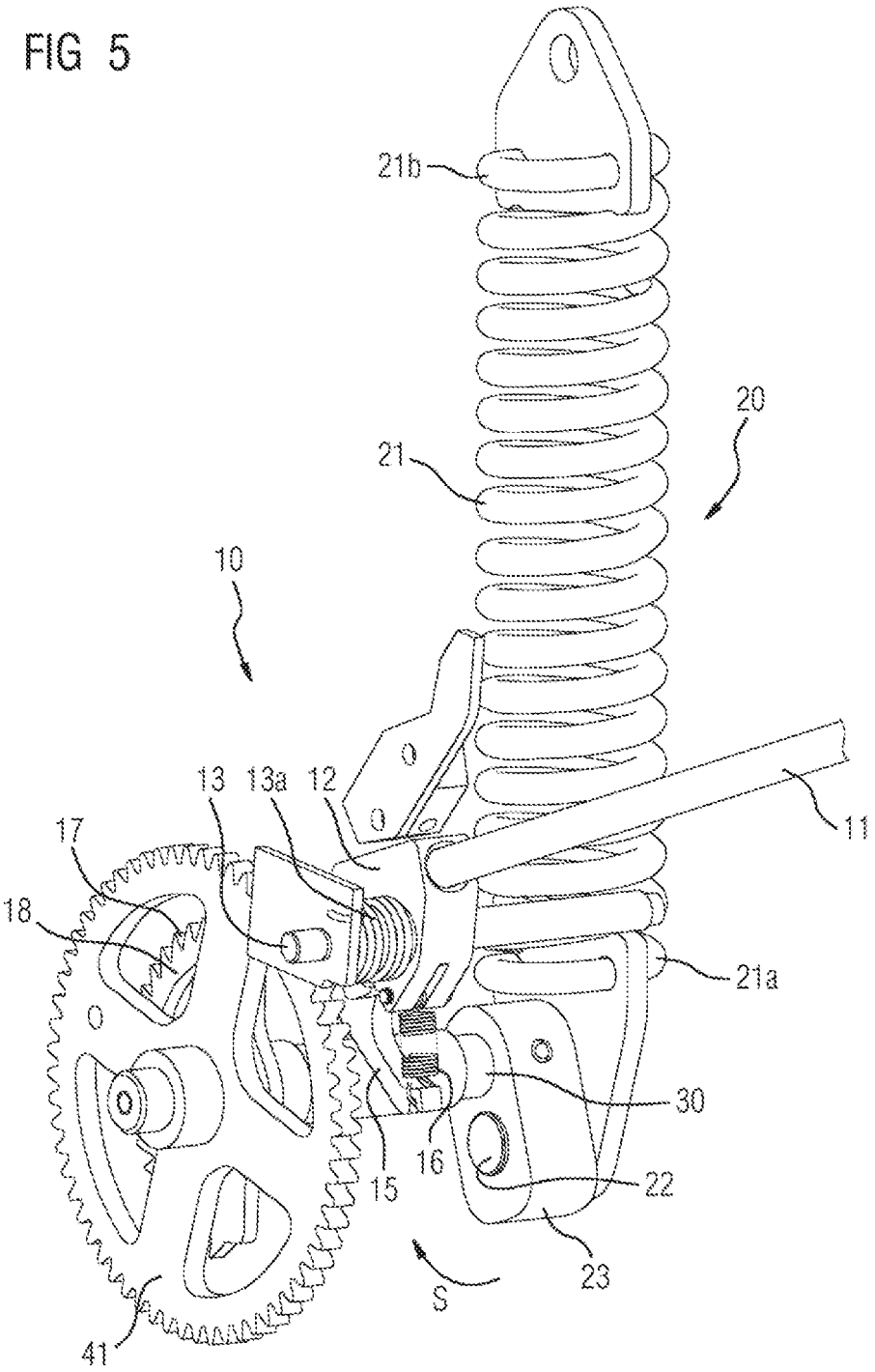
FIG. 5 shows another view of the circuit breaker according to FIG. 4, that is to say in the tensioned state of the spring.

FIG. 5 shows another view of the circuit breaker according to FIGS. 1 and 4 once again in the tensioned state of the spring 21. FIG. 5 therefore shows the same state of the spring 21 or of the stored-energy spring drive 20 as FIG. 4.

In summary, the shape of the external tooth system 17 in the form of an arc of a circle ensures that the manual operating device 11 is mechanically coupled to the switching shaft 30 only in the first rotation angle range of the switching shaft 30, that is to say during the tensioned phase, and cannot prevent relief of tension on the spring 21 when the switching shaft 30 is further rotated along the desired rotation direction S starting from the tensioned state, as is shown in FIG. 4. The asymmetry of the external tooth system 17 ensures that rotation of the switching shaft 30 along the desired rotation direction S independently of operation of the manual winding device 10 is possible, be it by a motor drive of the circuit breaker or some other intervention; feedback to the operating device 11 in the event of incorrect operation of the circuit breaker is therefore reliably prevented.

Although the invention has been illustrated and described in greater detail by the preferred example embodiments, the invention is not restricted by the disclosed examples and other variations can be derived therefrom by a person skilled in the art without departing from the scope of protection of the invention.

LIST OF REFERENCE SYMBOLS

10 Manual winding device
11 Operating device
12 Rocker
13 Rocker axis
13*a* Rotary spring
14 Pivot axis
15 Latching pawl
16 Positioning spring
17 External tooth system
18 Latching disk
19 Stop
19*a* Elongate hole
19*b* Bolt
20 Stored-energy spring drive
21 Spring
21*a* Bottom spring end
21*b* Top spring end
22 Fastening bolt
23 Eccentric element
20 Switching shaft
20 Return movement-limiting mechanism
41 Gear wheel
S Desired rotation direction

The invention claimed is:

1. An electrical circuit breaker comprising:

a stored-energy spring drive including a spring and a manual winding device for manually tensioning the spring, the manual winding device including a rotatable latching disk, a latching pawl arranged next to the latching disk, and a manual operating device connected to the latching pawl and configured to move the latching pawl, the latching pawl being guidable in a controlled manner into a latching tooth system of the latching disk and, by virtue of operation of the manual operating device, the latching pawl being movable and rotatable along a desired rotation direction to tension the spring, the latching tooth system being asymmetrical such that transmission of force from the latching pawl to the latching disk is possible only along the desired rotation direction, the latching disk being configured to slide along the latching pawl when the latching disk rotates along the desired rotation direction relatively more quickly than the latching pawl, the latching tooth system of the latching disk being an external tooth system in a form of an arc of a circle, an angle of the arc of the circle having an angle value of between 160° and 200° inclusive, wherein the latching disk is connected in a rotationally fixed manner to a switching shaft of the circuit breaker, the spring of the stored-energy spring drive forms a switch-on spring, and a first rotation angle range of the switching shaft, in an event of rotation along the desired rotation direction, serves to tension the spring, and a second rotation angle range of the switching shaft, in an event of rotation along the desired rotation direction, serves to relieve the spring of tension and to switch on the circuit breaker.

2. The circuit breaker of claim 1, wherein the external tooth system of the latching disk and the latching pawl are arranged relative to one another such that the latching pawl is configured to engage into the external tooth system when the switching shaft is in the first rotation angle range.

3. The circuit breaker of claim 2, wherein the external tooth system of the latching disk and the latching pawl are arranged relative to one another such that the latching pawl disengages from the external tooth system when the switching shaft is in the second rotation angle range.

4. The circuit breaker of claim 3, wherein the manual winding device includes a rocker, pivotable about a fixed rocker axis and on which the latching pawl is configured to be held to pivot about a pivot axis, and wherein the pivot axis lies parallel to the rocker axis and, upon the rocker being pivoted about the rocker, the pivot axis of the latching pawl is rotated about the rocker axis.

5. The circuit breaker of claim 4, wherein a pivot region of the latching pawl is delimited in a direction of the latching disk by way of a stop.

6. The circuit breaker of claim 2, wherein the manual winding device comprises a positioning spring, configured to generate a spring force on the latching pawl in a direction of the latching disk.

7. The circuit breaker of claim 1, wherein a spring end of the spring of the stored-energy spring drive is fastened to the switching shaft in an eccentric manner, in relation to an axis of the shaft, and a rotation axis of the latching disk and the axis of the switching shaft are identical.

8. The circuit breaker of claim 1, further comprising:

a return movement-limiting mechanism, configured to prevent rotation of the latching disk counter to the desired rotation direction.

9. The circuit breaker of claim 8, wherein the return movement-limiting mechanism comprises a gear wheel, arranged on the switching shaft of the circuit breaker coaxially to the latching disk in a manner fixed in terms of rotation.

10. The circuit breaker of claim 1, wherein the latching pawl is arranged at an end of the latching disk.

11. The circuit breaker of claim 3, wherein the manual winding device comprises a positioning spring, configured to generate a spring force on the latching pawl in the direction of the latching disk.

12. An electrical circuit breaker, comprising:

a stored-energy spring drive including a spring and a manual winding device for manually tensioning the spring, the manual winding device including a rotatable latching disk, a latching pawl arranged next to the latching disk, and a manual operating device connected to the latching pawl and configured to move the latching pawl, the latching pawl being guidable in a controlled manner into a latching tooth system of the latching disk and, by virtue of operation of the manual operating device, the latching pawl being movable and rotatable along a desired rotation direction to tension the spring, the latching tooth system being asymmetrical such that transmission of force from the latching pawl to the latching disk is possible only along the desired rotation direction, the latching disk being configured to slide along the latching pawl when the latching disk rotates along the desired rotation direction relatively more quickly than the latching pawl, wherein the latching tooth system of the latching disk is an external tooth system in a form of an arc of a circle, and wherein the latching disk is connected in a rotationally fixed manner to a switching shaft of the circuit breaker, the spring of the stored-energy spring drive forms a switch-on spring, and a first rotation angle range of the switching shaft, in an event of rotation along the desired rotation direction, serves to tension the spring, and a second rotation angle range of the switching shaft, in an event of rotation along the desired rotation direction, serves to relieve the spring of tension and to switch on the circuit breaker.

13. The circuit breaker of claim 12, wherein the external tooth system of the latching disk and the latching pawl are arranged relative to one another such that the latching pawl is configured to engage into the external tooth system when the switching shaft is in the first rotation angle range.

14. The circuit breaker of claim 13, wherein the external tooth system of the latching disk and the latching pawl are arranged relative to one another such that the latching pawl disengages from the external tooth system when the switching shaft is in the second rotation angle range.

15. An electrical circuit breaker, comprising:

a stored-energy spring drive including a spring and a manual winding device for manually tensioning the spring, the manual winding device including a rotatable latching disk, a latching pawl arranged next to the latching disk, a manual operating device connected to the latching pawl and configured to move the latching pawl, the latching pawl being guidable in a controlled manner into a latching tooth system of the latching disk and, by virtue of operation of the manual operating device, the latching pawl being movable and rotatable along a desired rotation direction to tension the spring, the latching tooth system being asymmetrical such that transmission of force from the latching pawl to the latching disk is possible only along the desired rotation direction, the latching disk being configured to slide along the latching pawl when the latching disk rotates along the desired rotation direction relatively more quickly than the latching pawl, and a rocker, pivotable about a fixed rocker axis and on which the latching pawl is configured to be held to pivot about a pivot axis, wherein the pivot axis lies parallel to the rocker axis and wherein, upon the rocker being pivoted about the rocker axis, the pivot axis of the latching pawl is rotated about the rocker axis.

16. The circuit breaker of claim 15, wherein a pivot region of the latching pawl is delimited in a direction of the latching disk by way of a stop.

17. The circuit breaker of claim 15, further comprising:

a return movement-limiting mechanism, configured to prevent rotation of the latching disk counter to the desired rotation direction.

18. The circuit breaker of claim 17, wherein the return movement-limiting mechanism comprises a gear wheel, arranged on a switching shaft of the circuit breaker coaxially to the latching disk in a manner fixed in terms of rotation.

19. The circuit breaker of claim 15, wherein the external tooth system of the latching disk and the latching pawl are arranged relative to one another such that the latching pawl is configured to engage into the external tooth system when the switching shaft is in the first rotation angle range.

20. The circuit breaker of claim 19, wherein the external tooth system of the latching disk and the latching pawl are arranged relative to one another such that the latching pawl disengages from the external tooth system when the switching shaft is in the second rotation angle range.

* * * * *